United States Patent [19]

Griffiths et al.

[11] Patent Number: 4,836,811

[45] Date of Patent: Jun. 6, 1989

[54] TRANSOM EXTENSION MOUNTING ASSEMBLY FOR OUTBOARD MOTORS

[75] Inventors: John M. Griffiths, Fond du Lac; John J. Litjens; Neil A. Newman, both of Omro, all of Wis.

[73] Assignee: Brunswick Corporation, Skokie, Ill.

[21] Appl. No.: 100,216

[22] Filed: Sep. 23, 1987

[51] Int. Cl.[4] ..... B63H 21/26

[52] U.S. Cl. ..... 440/61; 248/642

[58] Field of Search ..... 440/63, 53, 61, 900; 248/640–643

[56] References Cited

U.S. PATENT DOCUMENTS

| | | | |
|---|---|---|---|
| 2,737,920 | 3/1956 | Heath | 440/61 |
| 2,782,744 | 2/1957 | Staley | 248/642 |
| 3,033,500 | 5/1962 | Graves | 248/641 |
| 3,567,164 | 3/1971 | Hakala | 248/641 |
| 3,948,472 | 4/1976 | Metcalf | 248/642 |
| 3,990,660 | 11/1976 | Pipoz | 248/640 |
| 4,013,249 | 3/1977 | Meyer et al. | 440/61 |
| 4,168,818 | 9/1979 | Ellis | 248/643 |
| 4,306,703 | 12/1981 | Finze | 248/642 |
| 4,354,848 | 10/1982 | Hall et al. | 440/61 |
| 4,363,629 | 12/1982 | Hall et al. | 440/61 |
| 4,367,860 | 1/1983 | Strang | 248/641 |
| 4,384,856 | 5/1983 | Hall et al. | 440/61 |
| 4,406,632 | 9/1983 | Blanchard | 440/61 |
| 4,406,634 | 9/1983 | Blanchard | 440/61 |
| 4,482,332 | 11/1984 | Emmons | 440/53 |
| 4,504,237 | 3/1985 | Blanchard | 440/61 |
| 4,673,358 | 6/1987 | Iwai et al. | 440/61 |
| 4,682,961 | 7/1987 | Nakahama | 440/61 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A mounting assembly for an outboard motor includes a motor mount having a transom mounting bracket attachable to a boat transom and a motor supporting bracket spaced aft of and pivotally connected by upper and lower links with the transom mounting bracket to support an outboard motor wholly aft of the boat transom, and cylinder means for moving the motor supporting bracket relative to the transom mounting bracket to simultaneously move the outboard motor between raised and lowered positions in a vertical plane which extends parallel to the longitudinal dimension of a boat and to rotate the motor about a horizontal axis which extends perpendicular to the vertical plane. The movement of the outboard motor is provided by the motor mount being a quadrilateral structure wherein the lower link is shorter in length than the upper link and the motor supporting bracket is shorter in length than the transom mounting bracket.

2 Claims, 2 Drawing Sheets

TRANSOM EXTENSION MOUNTING ASSEMBLY FOR OUTBOARD MOTORS

BACKGROUND OF THE INVENTION

The present invention relates to marine propulsion devices, and more particularly to a transom extension mounting assembly for an outboard motor.

Marine propulsion devices such as outboard motors are supported from a boat transom by a motor mounting assembly. Various types of motor mounting assemblies are known, as for example a transom bracket for mounting the outboard motor directly on a boat transom. While the motor may be trimmed when mounted on a transom bracket, the motor's vertical height cannot be changed. Therefore, the outboard motor is typically mounted at a comprising position at a fixed height which will provide the best possible overall performance. Another type of motor mounting assembly relates to one which is capable of selectively supporting an outboard motor in either raised or lowered positions wholly aft of the boat transom. Many of these latter transom extension types of mounting assemblies are of the general type which include a parallelogram linkage.

Recently, transom extension mounting assemblies have become increasingly popular on high performance outboard motor powered boats including bass boats where a lower position of the motor improves initial boat acceleration, and a higher position enhances top speed by reducing gear case drag and reducing draft for shallow water operation. It is further known that relocating the motor aft of the transom improves the handling characteristics of most boats at high speeds. These devices also allow the boat to have a higher transom for improved safety in following-wave conditions and they allow boat builders to manufacture a common hull/-transom design for both outboard and stern drive applications.

Examples of outboard motor mounting assemblies which support the outboard motor wholly aft of the boat transom are disclosed in the following United States patents:

| U.S. Pat. No. | Inventor | Issue Date |
|---|---|---|
| 2,737,920 | Heath | 1956 |
| 2,782,744 | Staley | 1957 |
| 3,990,660 | Pipoz | 1976 |
| 4,013,249 | Meyer et al | 1977 |
| 4,168,818 | Ellis | 1979 |
| 4,306,703 | Finze | 1981 |
| 4,354,848 | Hall et al | 1982 |
| 4,363,629 | Hall et al | 1982 |
| 4,367,860 | Strang | 1983 |
| 4,384,856 | Hall et al | 1983 |
| 4,406,632 | Blanchard | 1983 |
| 4,406,634 | Blanchard | 1983 |
| 4,482,332 | Emmons | 1984 |
| 4,504,237 | Blanchard | 1985 |

One limitation of a parallelogram linkage arrangement is that the outboard motor is raised and lowered along a substantially vertical plane. This results in a horizontal thrust plane throughout the full movement of the outboard motor between its raised and lowered positions. Thus, for example, when the outboard motor is in its fully lowered position and the boat is accelerated rapidly the front of the boat becomes elevated or raised out of the water which results in the propeller axis or thrust plane angled upwardly with respect to a horizontal plane, i.e. the water surface, instead of being parallel to the water surface which would provide maximum thrust and speed. Ideally therefore the outboard motor should be orientated so that its thrust plane is parallel with respect to a horizontal plane, such as the water surface, regardless of whether the boat is accelerating or cruising. Additionally, it is desirable to be able to move the outboard motor between a lowered position, which is advantageous for acceleration purposes, and a plurality of raised positions which are advantageous for cruising purposes under varying load and water conditions. Such optimum orientations would aid in providing maximum thrust and speed resulting in maximum efficiency and performance from the outboard motor.

SUMMARY OF THE INVENTION

A mounting assembly for one or more marine propulsion devices comprises a motor mounting means for supporting a marine propulsion device aft of a boat transom, said motor mounting means includes a first portion attachable to a boat transom or other boat structure and a second portion adapted to support the marine propulsion device, and means for moving the second portion relative to the first portion to simultaneously move, by raising and lowering, the marine propulsion device relative to the boat transom in a vertical plane which extends parallel to the longitudinal dimension of a boat and to rotate the motor about a horizontal axis which extends perpendicular to the vertical plane. The rotation results in an increase in the angle formed between a longitudinal axis of the motor defined as being parallel to the driveshaft axis of the motor and a horizontal plane defined as the water surface, when the motor is moved from its raised position to its lowered position.

In one form, the motor mounting means includes a first bracket attachable to the boat transom having upper and lower ends, and a second bracket spaced aft of the first bracket and adapted to support the marine propulsion device having upper and lower ends, and the moving means includes an upper link pivotably connected at its ends to the upper ends of the first and second brackets, and a lower link pivotally connected at its ends to the lower ends of the first and second brackets. The links may be of equal lengths or unequal lengths, as desired, with the brackets being of unequal length. Preferably, the lower link is shorter in length than the upper link, and the second bracket is shorter in length than the first bracket so that a quadrilateral structure is provided whereby the outboard motor is simultaneously raised or lowered and rotated during movement thereof.

The moving means may comprise cylinder means having its cylinder end connected to the pivotable connection between one of the links and one of the brackets, and its rod end connected to the pivotable connection between the other of the links and the other of the brackets.

The present invention thus provides a motor mounting assembly for an outboard motor which advantageously orientates the motor with respect to the surface of the water. In particular with the mounting assembly in its fully down position a boat can accelerate to planing speed without the problem of propeller cavitation, and further the initially downwardly angled thrust plane of the propeller becomes parallel to the surface of the water during forward movement of the boat and in particular during rapid acceleration onto a planing attitude since the fore end of a boat rises during acceleration.

Once planing is obtained the operator can raise the motor mounting assembly to raise and rotate the motor to adjust the orientation of the thrust plane in order to obtain maximum efficiency and performance from the outboard during cruising. This cruising position also eliminates the undesirable spray from mounting the outboard in a lower compromising position which may normally occur with other transom extension structures.

Additionally, when coming off plane from a cruising position, the present motor mounting assembly aids in keeping the engine dry through its ability to raise the engine.

Another feature of the present motor mounting assembly is its ability to raise the outboard to a relatively high height. With the outboard raised, the boat now has a superior shallow water drive with a substantially horizontal thrust plane which allows the boat to maneuver in the same depth water that will float it.

Yet another feature is that when launching, there is no problem of drowning the outboard because it may be located higher than normal and the advantage of a full tilt position is still retained. Finally, when mooring, the motor mounting assembly can be raised to it's maximum height and the outboard tilted to it's maximum tilt to completely remove the outboard from the water. This would be very important in salt water to aid in preventing corrosion.

Other features and advantages of the invention will become apparent to those skilled in the art upon reviewing the following detailed description, the drawings, and the appended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 2:
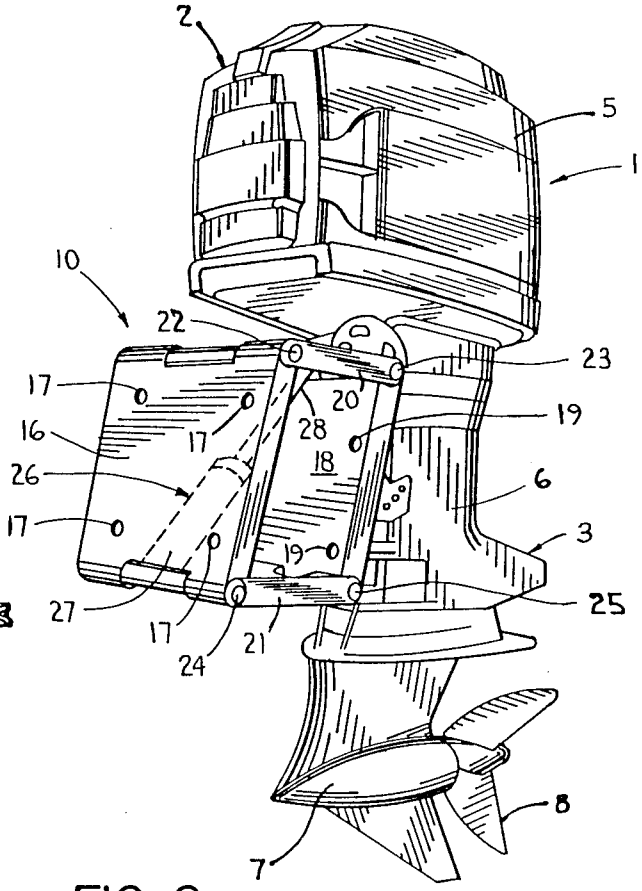
FIG. 2 is a perspective rear view of the motor mounting assembly with the transom removed for clarity.
Figure 1:
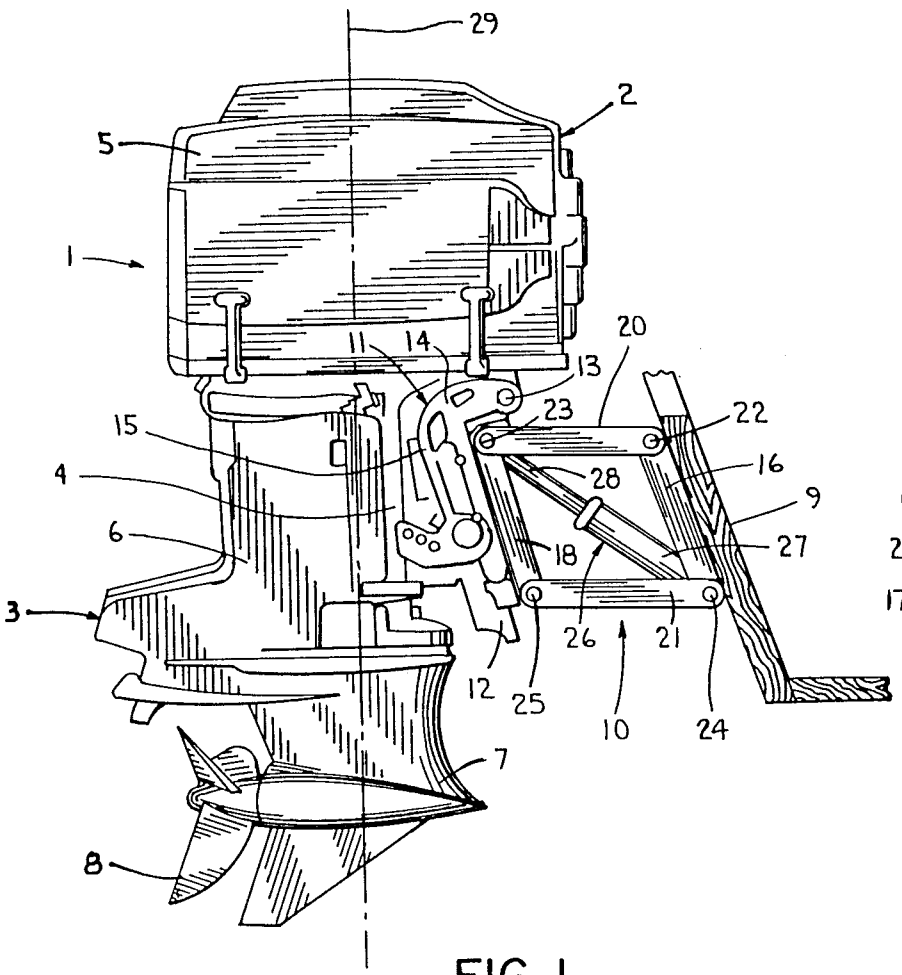
FIG. 1 is a perspective side view of an outboard motor mounting assembly in accordance with the present invention.

Referring now to the drawings, FIGS. 1 and 2 illustrate a marine propulsion drive in the form of an outboard motor 1 having a propulsion assembly including an upper unit or powerhead 2, a lower unit 3 and swivel bracket 4. Upper unit 2 includes a cover or cowl 5 defining an engine compartment for housing an internal combustion engine (not shown).

Lower unit 3 is rigidly mounted to the bottom of the powerhead or upper unit 2 and includes drive shaft housing 6 and a gear case 7. Gear case 7 is normally submerged in water during operation of outboard motor 1 and supports a rotatable propeller shaft carrying a propeller 8. Gear case 7 houses a suitable reversing transmission which drivingly connects propeller 8 to a drive shaft extending through the drive shaft housing 6 which drivingly interconnects the engine with propeller 8.

Lower unit 3 is connected to swivel bracket 4 for swivel or turning movement about a vertical axis and in a horizontal plane to provide steering control for outboard motor 1, as is conventional.

Outboard motor 1 is supported from a transom 9 of a boat by a mounting assembly 10, hereinafter to be described, and a transom bracket 11 on which swivel bracket 4 is mounted. Outboard motor 1 including swivel bracket 4 is connected to transom bracket 11 for pivotal or tilting movement about a horizontal transverse axis and in a vertical plane, which extends parallel to the longitudinal dimension of a boat, between an operating position wherein gear case 7 and propeller 8 are fully submerged in water, and a tilted or nonoperating position wherein gear case 7 and propeller 8 are raised from the water, as for trailering.

Transom bracket 11 includes two spaced apart clamp members or mounting members 12 (only one of which is shown in FIG. 1) for removably mounting outboard motor 1 to mounting assemby 10. Clamp members 12 of transom bracket 11 are connected by a pivot pin or tilt shaft 13 which extends substantially horizontally between the upper ends of clamp members 12. Each clamp member 12 has an upper body portion 14 with an integral outside leg 15 extending downwardly therefrom which includes a plurality of vertically spaced bolt-receiving openings (not shown) therein. Transom bracket 11 and thus outboard motor 1 may be removably mounted and secured to mounting assembly 10 by means of through bolts (not shown) in the conventional manner.

Figure 3:
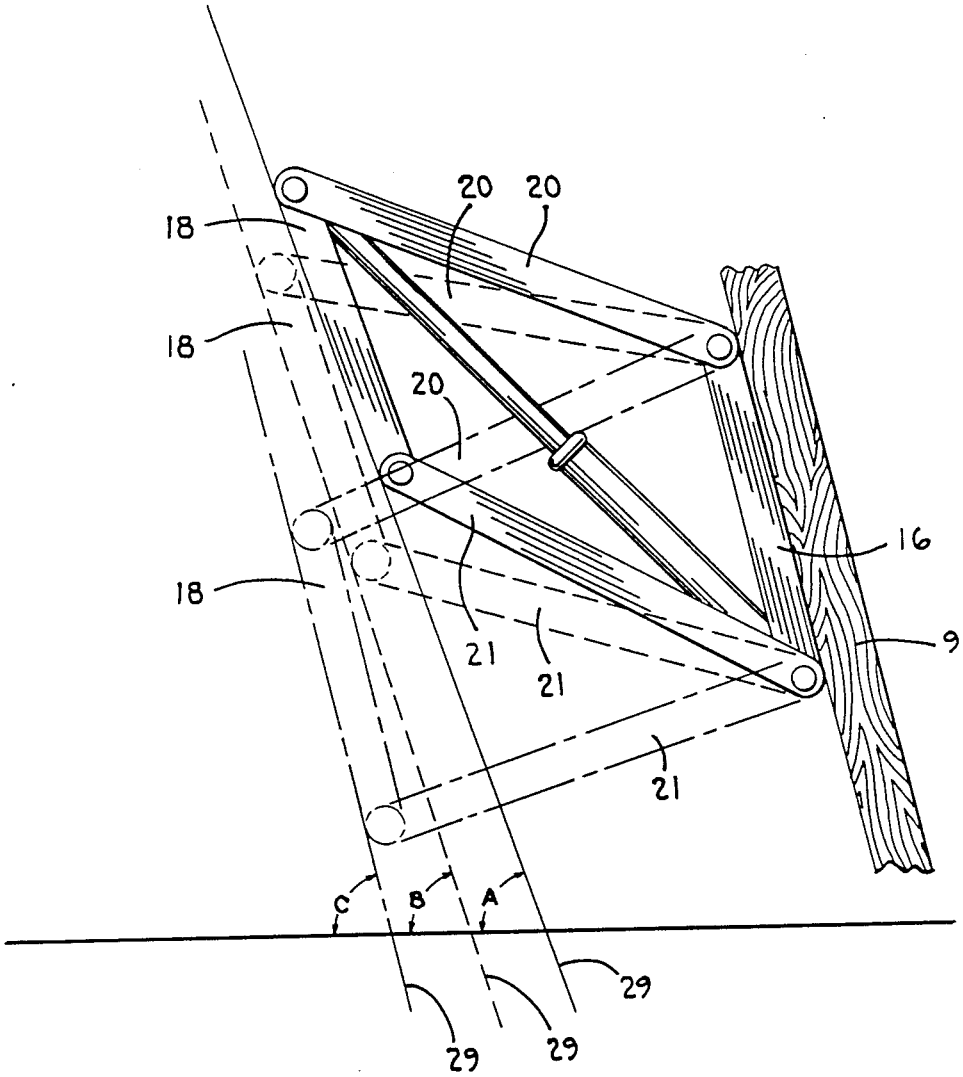
FIG. 3 is a schematic side view of the motor mounting assembly illustrating the movement of an outboard motor between raised and lowered positions.

Mounting assembly 10 is in the form of a quadrilateral linkage, and comprises a first or transom mounting bracket 16 adapted to be attached to the boat transom 9 by means of bolts (not shown) passing through four openings 17 (see FIG. 2) into transom 9, a second or motor supporting bracket 18 adapted to support the outboard motor 1 by means of bolts (not shown) passing through openings 19 (see FIG. 2) into transom bracket 11, an upper link 20 extending between the upper ends of brackets 16 and 18, and a lower link 21 extending between the lower ends of brackets 16 and 18. Links 20 and 21 each include a fore end closest to transom 9 and an aft end spaced from transom 9 and closest to motor 1. Fore end of upper link 20 is pivotally connected at 22 to the upper end of transom mounting bracket 16, and the aft end of upper link 20 is pivotally connected at 23 to the upper end of motor supporting bracket 18. Likewise, the fore end of lower link 21 is pivotally connected at 24 to the lower end of transom mounting bracket 16, and the aft end of lower link 21 is pivotally connected at 25 to the lower end of motor supporting bracket 18. As shown best in FIG. 2, brackets 16, 18 and links 20, 21 are in the form of plates which provide dimensional rigidity for mounting assembly 10. As best shown in FIG. 3, bracket 18 is shorter in length than bracket 16, and link 21 is shorter in length than link 20 to provide a quadrilateral linkage arrangement. Typically, bracket 18 might be 16 inches in length while bracket 16 might be 18 inches in length, and link 21 might be 23.75 inches long while link 20 might be 24 inches long. The pivotal connections 22–25 are provided by respective bolts or pins which extend through the pivotally connected components. The bolts or pins which provide pivotal connections 22–25 may also be rubber bushed to reduce wear, corrosion, noise and/or vibration.

Means is also provided for selectively moving motor supporting bracket 18 relative to transom mounting bracket 16 and transom 9 between a first position locating motor supporting bracket 18 in a lower position and second position locating the motor supporting bracket 18 in a raised position. In order to accomplish this, a hydraulic cylinder 26 extends between the pivotal connections 23 and 24. As shown in the drawings, hydraulic cylinder 26 has its cylinder end 27 connected to pivotal connection 24, and its rod end 28 connected to pivotal connection 23. It should be noted, however, that the orientation of cylinder 26 may be revised so that end 27 is connected at 23 and end 28 is connected at 24. Additionally, one end of cylinder 26 may be mounted on transom 9 and its other end connected to link 20, link 21, bracket 18, pivotal connection 23 or pivotal connection 25, if desired. Thus, upon extension of cylinder 26 bracket 18 and motor 1 may be moved to an elevated or raised position while upon retraction of cylinder 26 bracket 18 and motor 1 are moved to a lowered position.

Due to the configuration of mounting assembly 10 as a quadrilateral, extension and retraction of hydraulic cylinder 26 moves longitudinal axis 29 of motor 1 in a vertical plane which extends parallel to the longitudinal dimension of a boat. As shown best in FIG. 1, axis 29 is defined as being parallel to the axis of the driveshaft contained within driveshaft housing 6. Simultaneously with the raising or lowering of motor 1, actuation of cylinder 26 also rotates the motor about a horizontal axis which extends parallel to the axis of tilt shaft 13 and transverse or perpendicular to the vertical plane containing axis 29. As shown best in FIG. 3, motor 1 rotates in a clockwise direction so that the angle formed between axis 29 of motor 1 and a horizontal plane as at 30, such as the surface of the water, increases as motor 1 is moved from a raised position (shown in solid lines in FIG. 3) to an intermediate position (shown in dotted lines in FIG. 3) to a lowered position (shown in dot-dash lines in FIG. 3). For example, in FIG. 3 angle A formed between axis 29 and plane 30 when mounting assembly 10 is raised is about 71° whereas angle B formed when assembly 10 is in an intermediate position is about 73°, and angle C formed when assembly 10 is in a lowered position is about 78°.

In operation, when mounting assembly 10 is moved by cylinder 26 to its full lowered position, the propeller thrust plane is disposed or orientated downwardly at an angle with respect to horizontal plane 0. This orientation or position advantageously positions the thrust plane of propeller 8 parallel to plane 30 during forward movement of the boat and in particular, during rapid acceleration of a boat onto a planing attitude. Once planing is obtained, mounting assembly 10 may be raised from its lower position to obtain maximum efficiency and performance from outboard motor 1. Since the front of the boat drops downwardly after obtaining a planing attitude, the thrust plane of propeller 8 once again is located parallel to plane 30 when assembly 10 is raised during cruising. In this latter position, motor 1 has the ability to be used as a shallow water drive which allows the boat to manuever in relatively shallow water. Thus, motor 1 may be raised and/or lowered and/or rotated to various positions as desired to obtain maximum efficiency and performance.

A mounting assembly for an outboard motor has been illustrated and described. Various modifications and/or substitutions of the specific components described and illustrated herein may be made without departing from the scope of the present invention. For example, brackets 16, 18 and links 20, 21 may be composed of a frame work of bars as opposed to the rigid plates described and illustrated herein. Additionally, any one of brackets 16, 18 and/or links 20, 21 may be a hydraulic cylinder which may be controlled to accomplish the movements described and illustrated herein. Further, bracket 16 may be mounted other than directly against transom 9. In other words, bracket 16 may be mounted within the boat hull so that bracket 18 is near flush with transom 9. Additionally, links 20 and 21 may be of equal lengths rather than unequal lengths as specifically illustrated and described herein. Finally, although the mounting assembly is illustrated and described with respect to mounting only a single outboard motor, it is apparent that it could readily be adapted for mounting multiple outboard motors on a boat, if desired.

Various modes of carrying out the invention are contemplated as being within the scope of the following claims particularly pointing out and distinctly claiming the subject matter which is regarded as the invention.

I claim:

1. A mounting assembly for mounting a marine propulsion device on a boat, comprising:

motor mounting means for supporting a marine propulsion device including a first portion attachable to a boat and a second portion adapted to support the marine propulsion device aft of a boat transom, said first portion includes a first bracket attachable to a boat transom and having upper and lower ends, said second portion includes a second bracket spaced aft of said first bracket and adapted to support the marine propulsion device, said second bracket having upper and lower ends;

means for moving said second portion relative to said first portion during boat operation to simultaneously move the marine propulsion device between various raised, intermediate and lowered positions relative to the boat transom in a vertical plane which extends parallel to the longitudinal dimension of a boat and to rotate the marine propulsion device about a horizontal axis which extends perpendicular to the vertical plane, said moving means includes an upper link pivotally connected at one of its ends to the upper end of said first bracket to define a first pivot axis and pivotally connected at its other end to the upper end of said second bracket to define a second pivot axis, and a lower link pivotally connected at one of its ends to the lower end of said first bracket to define a third pivot axis and pivotally connected at its other end to the lower end of said second bracket to define a fourth pivot axis, wherein the distance between said first and third axes is greater than the distance between said second and fourth axes and the distance between said first and second axes is greater than the distance between said third and fourth axes so as to define a quadrilateral linkage assembly, and said moving means further includes cylinder means actuatable to move said second bracket relative to said first bracket so that said rotation results in an increase of an angle formed between a longitudinal axis of the propulsion device and a horizontal plane as the propulsion device moves from its raised position to its lowered position and a decease in said angle as the propulsion device moves from its lowered position to its raised position.

2. The mounting assembly of claim 1 wherein said cylinder means has its cylinder end connected to the pivotal connection between one of said links and one of said brackets and its rod end connected to the pivotal connection between the other of said links and the other of said brackets.

* * * * *